United States Patent [19]

Reich et al.

[11] Patent Number: 4,830,768

[45] Date of Patent: May 16, 1989

[54] METALWORKING LUBRICANT COMPOSITION CONTAINING PROPOXYLATED FATTY ALCOHOL

[75] Inventors: Ronald A. Reich, Shaler Township, Allegheny County; Ronald P. Festa, New Kensington, both of Pa.

[73] Assignee: Aluminum Company of America, Pittsburgh, Pa.

[21] Appl. No.: 158,694

[22] Filed: Feb. 22, 1988

[51] Int. Cl.[4] ..... C10M 173/02

[52] U.S. Cl. ..... 252/49.3; 252/51.5 R; 252/52 R; 252/52 A; 252/56 R

[58] Field of Search ..... 252/49.3, 51.5 R, 52 R, 252/52 A, 56 R

[56] References Cited

U.S. PATENT DOCUMENTS

| | | | |
|---|---|---|---|
| 2,831,782 | 4/1958 | Zvanut | 117/127 |
| 2,981,686 | 4/1961 | Reamer | 252/49.3 |
| 3,124,531 | 3/1964 | Whetzel et al. | 252/52 |
| 3,244,638 | 4/1966 | Foley et al. | 252/308 |
| 3,311,557 | 3/1967 | Schiermeier et al. | 252/49.3 |
| 3,374,171 | 3/1968 | Davis | 252/49.3 |
| 3,507,792 | 4/1970 | Zuraw | 252/49.3 |
| 3,630,898 | 12/1971 | Teeter et al. | 252/49.3 |
| 3,937,676 | 2/1976 | Shonebarger et al. | 252/49.3 |
| 4,036,771 | 7/1977 | Denis et al. | 252/56 R |
| 4,243,537 | 1/1981 | Knepp et al. | 252/49.3 |
| 4,359,393 | 11/1982 | Sturwold | 252/49.3 |
| 4,430,234 | 2/1984 | Hasegawa et al. | 252/49.3 |
| 4,461,712 | 7/1984 | Jonnes | 252/49.3 |
| 4,636,321 | 1/1987 | Kipp et al. | 252/49.3 |
| 4,668,410 | 5/1987 | Haas et al. | 252/49.3 |

*Primary Examiner*—William R. Dixon, Jr.
*Assistant Examiner*—Ellen McAvoy
*Attorney, Agent, or Firm*—Glenn E. Klepac

[57] ABSTRACT

A metalworking lubricant composition comprising a propoxylated fatty alcohol; a carboxylic acid, carboxylic acid ester, or mixture of said acid and said ester; and water. The composition demonstrates a reduced tendency to form soap and sludge and to increase in viscosity compared with prior art lubricant compositions containing mineral oil.

16 Claims, No Drawings

METALWORKING LUBRICANT COMPOSITION CONTAINING PROPOXYLATED FATTY ALCOHOL

FIELD OF THE INVENTION

The present invention relates to lubricant compositions and to their utilization in various metalworking operations including the hot rolling and cold rolling of aluminum and aluminum alloys.

BACKGROUND OF THE INVENTION

In the rolling of aluminum and aluminum alloy sheet material, it is customary to flood the rolls and sheet material with a coolant for the purpose of reducing friction and carrying away heat generated by the operation. The coolant generally comprises a mineral oil-in-water emulsion and various non-petroleum additives. Numerous compositions having satisfactory coolant and friction-modifying properties are known in the prior art.

One disadvantage of prior art mineral oil/water emulsion coolants is that they are degraded at elevated temperatures especially the high temperatures employed in hot rolling of metals. Upon degradation, soaps are formed which cause smudging of the metal sheet. Such degradation is accelerated at high temperatures by evaporation of low molecular weight components of the oil and by oxidation. Because of these changes, there is an increase in sludge formation and an increase in lubricant viscosity. The ultimate result may be loss of mill control.

In order to deal with the above-listed effects in a hot rolling environment, one or more countermeasures is customarily employed. Oxidation inhibitors are added to the coolant; the used coolant is filtered and distilled to recover useful components; and, as a last resort, the used coolant is completely discarded. Because each of these countermeasures involves additional expense, there are several benefits to be gained if a hot rolling lubricant is formulated to have increased resistance to degradation.

A principal objective of the present invention is to provide a lubricant composition having increased resistance to degradation at elevated temperatures.

A related objective of the invention is to provide an oil-free lubricant composition having satisfactory friction and wear characteristics for hot rolling aluminum alloy sheet material.

It is a further object of the present invention to provide a metalworking method using the claimed lubricant composition.

Additional objects and advantages of the present invention will become apparent to persons skilled in the art from the following detailed description.

SUMMARY OF THE INVENTION

In accordance with the present invention, there is provided a lubricant composition having increased resistance to degradation at elevated temperatures compared with compositions containing mineral oil. The composition of the invention has good friction and wear properties in metal fabricating operations. The composition is especially useful for hot rolling of aluminum and aluminum alloys into sheet and foil form.

As used herein, the term "hot rolling" refers to rolling that takes place at a metal entry temperature of approximately 450°–1000° F. (232°–538° C.) for aluminum alloys. Hot rolling is typically used to reduce slabs of aluminum alloy material that are several inches thick into sheets having a thickness of about ⅛ inch.

The term "cold rolling" refers to rolling in which metal entry temperature may range from approximately ambient temperature to about 450° F. (232° C.) for aluminum alloys. Metal entry temperature is ordinarily about ambient temperature. Cold rolling is typically used to reduce sheets of aluminum alloy material about ⅛ inch thick into lesser thicknesses.

The composition generally comprises a propoxylated $C_5$–$C_{16}$ fatty alcohol; a friction-modifying agent comprising a carboxylic acid, an alkyl ester of said carboxylic acid, or a mixture of said carboxylic acid and said ester; and water.

The alcohol portion of the propoxylated fatty alcohol generally contains about 10–16 carbon atoms, preferably about 10–14. Lauryl alcohol, containing 12 carbon atoms, is utilized in a particularly preferred embodiment. The lauryl alcohol is preferably unsubstituted. However, the alcohol hydrogen may be replaced with a methyl group on a less preferred basis.

The propoxylated fatty alcohol is water-insoluble because it is substituted with about 1–15 moles of propylene oxide per alcohol mole. The compound preferably contains about 1–5 moles of propylene oxide and optimally about 3 moles.

The propoxylated fatty alcohol generally comprises about 1–15 wt % of the composition, preferably about 2–10 wt %. The alcohol comprises about 5 wt % in one particularly preferred embodiment.

The carboxylic acid may be a saturated or unsaturated $C_{11}$–$C_{36}$ mono- or dicarboxylic acid. The acid is preferably a saturated or mono-unsaturated or di-unsaturated or tri-unsaturated $C_{12}$–$C_{20}$ monocarboxylic acid. The acid is water-insoluble or sparingly soluble in water. Two preferred carboxylic acids are oleic and lauric acid. The carboxylic acid comprises about 0.4–8 wt % of the composition, preferably about 0.4–4 wt %.

The composition may also contain about 0.5–10 wt % of a $C_1$–$C_4$ alkyl ester of the carboxylic acid described above. A particularly preferred ester is butyl stearate. The ester may be utilized in place of or along with the acid. Compositions containing about 0.4–10 wt % of both an acid and an ester are particularly preferred.

The lubricant composition may also comprise about 0–5 wt % of a water-soluble alkanolamine or a water-soluble alkylene glycol. Some particularly preferred alkanolamines are triethanolamine, diethanolamine, and ethyldiisopropanolamine.

The glycol may be a $C_2$–$C_6$ alkylene glycol. Two preferred examples are ethylene glycol and hexylene glycol.

The lubricant composition also contains about 80–98 wt % water, preferably about 85–97 wt % and more preferably about 90–96 wt %. Deionized water is particularly preferred.

The lubricant composition may also contain up to about 4 wt % of an antifoam agent, biocide, oxidation inhibitor, corrosion inhibitor, or mixture thereof. When present, such additives generally comprise about 0.01–2 wt % of the composition. These additives are well known to persons skilled in the art of lubricant formulations.

DESCRIPTION OF A PREFERRED EMBODIMENT

A series of tests was performed to demonstrate efficacy of the lubricant composition of the present invention compared with a prior art lubricant emulsion. Four different lubricant compositions were prepared, all with 90 wt % water and 10 wt % of an additive package.

Composition A was made up with 10 wt % of an additive package comprising 80 wt % mineral oil having a viscosity of 100 SSU, 18 wt % butyl stearate, and 2 wt % oleic acid. Composition B comprised 90 wt % water and 10 wt % of an additive package containing 80 wt % propoxylated fatty alcohol having 100 SSU viscosity, 18 wt % butyl stearate, and 2 wt % oleic acid. In all cases, the propoxylated fatty alcohol was lauryl alcohol reacted with about 3 moles of propylene oxide per mole of the alcohol.

Composition C comprises 90 wt % water and 10 wt % of an additive package containing 80 wt % mineral oil having 100 SSU viscosity and 20 wt % linoleic acid. Composition D comprises 90 wt % water and 10 wt % of an additive package containing 80 wt % propoxylated fatty alcohol and 20 wt % linoleic acid.

The comparative tests were performed by spraying 2000 ml samples of each lubricant over an aluminum plate set at 250° C. One gram of 5182 aluminum alloy fines was added to each sample by grinding. After 0, 18, and 36 hours, the samples were analyzed for percentage oil content, viscosity, sludge, and metal soap formation. Degradation of a lubricant is generally manifested by loss of oil content, increase in viscosity, sludge formation, and the formation of metallic soaps.

Results of the comparative tests are shown in Tables 1 and 2.

TABLE 1

| Test Time | % Oil | | Viscosity Change (SSU) | | Sludge | | Soap Formation | |
|---|---|---|---|---|---|---|---|---|
| (hrs.) | A | B | A | B | A | B | A | B |
| 0 | 10.0 | 10.0 | 0 | 0 | 0 | 0 | No | No |
| 18 | 3.8 | 7.2 | 187 | 40 | — | — | — | — |
| 30 | 2.0 | 5.0 | 482 | 181 | High | Low | Yes | No |

TABLE 2

| Test Time | % Oil | | Viscosity Change (SSU) | | Sludge | | Soap Formation | |
|---|---|---|---|---|---|---|---|---|
| (hrs.) | C | D | C | D | C | D | C | D |
| 0 | 10.0 | 10.0 | 0 | 0 | 0 | 0 | No | No |
| 18 | 2.5 | 5.8 | 97 | 64 | — | — | — | — |
| 30 | 1.2 | 4.2 | 135 | 67 | High | Low | Yes | No |

Soap and sludge formation were observed with prior art Compositions A and C but not with B and D which each contained a propoxylated fatty alcohol rather than mineaal oil. Compositions A and C also showed a greater increase in viscosity and a larger decrease in oil volume than Compositions B and D.

These tests demonstrate that the lubricant composition of the present invention is an excellent candidate for hot rolling of aluminum alloy sheet material.

The foregoing description of our invention has been made with reference to a few preferred embodiments. Persons skilled in the art will understand that numerous variations can be made in the invention without departing from the spirit and scope of the following claims.

What is claimed is:

1. A lubricant composition comprising:

(a) about 1–15 wt % of a water-insoluble propoxylated fatty alcohol or ether having the formula:

$$CH_3(CH_2)_xO(CH_2\underset{\underset{CH_3}{|}}{CH}{-}O)_yR$$

wherein x=4–15, y=1–15, and R is hydrogen or a methyl group;

(b)

(1) about 0.4–8 wt % of a carboxylic acid of the general formula:

$$C_mH_{2m-n-r+2}(COOH)_r$$

where m is an integer from 11 to 36, n=0, 2, 4, or 6 and r=1 or 2, or (2) about 0.5–10 wt % of a $C_1$–$C_4$ alkyl ester of said carboxylic acid, or (3) about 0.4–10 wt % of a mixture of said carboxylic acid and said ester;

(c) about 0–5 wt % of a water-soluble alkanolamine or a water-soluble alkylene glycol; and (d) about 80–98 wt % water.

2. A lubricant as claimed in claim 1 wherein R is hydrogen, x=9–15 and y=1–5.

3. A lubricant as claimed in claim 1 wherein R is hydrogen, x=11 and y=3.

4. A lubricant as claimed in claim 1 further comprising:

(e) about 0.01–2 wt % of an antifoam agent, biocide, oxidation inhibitor, corrosion inhibitor, or mixture thereof.

5. A lubricant as claimed in claim 1 consisting essentially of:

(a) about 2–10 wt % of said propoxylated fatty alcohol or ether;

(b) about 0.4–4 wt % of a mixture of said carboxylic acid and said ester;

(c) about 0–2 wt % of a water-soluble alkanolamine or water-soluble $C_2$–$C_6$ alkylene glycol;

(d) about 85–97 wt % water; and (e) up to about 2 wt % of an antifoam agent, biocide, oxidation inhibitor, corrosion inhibitor, or mixture thereof.

6. A lubricant as claimed in claim 5 containing about 3–6 wt % of a propoxylated fatty alcohol wherein x=9–15 and y=1–5.

7. An oil-free lubricant composition having increased resistance to degradation at elevated temperatures, said composition consisting essentially of:

(a) about 1–15 wt % of a propoxylated $C_5$–$C_{16}$ water-isoluble fatty alcohol containing about 1–15 moles of propylene oxide per mole of said alcohol;

(b) a friction-modifying agent comprising:

(1) about 0.4–8 wt % of a saturated or unsaturated $C_{11}$–$C_{36}$ mono- or di-carboxylic acid, or (2) about 0.5–10 wt % of a $C_1$–$C_4$ alkyl ester of said carboxylic acid, or (3) about 0.4–10 wt % of a mixture of said carboxylic acid and said ester;

(c) about 0–5 wt % of a water-soluble alkanolamine or a water-soluble alkylene glycol;

(d) up to about 2 wt % of an antifoam agent, biocide, oxidation inhibitor, corrosion inhibitor, or mixture thereof; and (e) remainder, water.

8. A method of metalworking comprising applying to a metal object a lubricant composition containing:

(a) about 1–15 wt % of a water-isoluble propoxylated fatty alcohol or ether having the formula:

$$CH_3(CH_2)_xO(CH_2\underset{\underset{CH_3}{|}}{CH}-O)_yR$$

wherein x=4–15, y=1–15, and R is hydrogen or a methyl group;

(b)

(1) about 0.4–8 wt % of a carboxylic acid of the general formula:

$$C_mH_{2m-n-r+2}(COOH)_r$$

where m is an integer from 11 to 36, n=0, 2, 4, or 6 and r=1 or 2, or (2) about 0.5–10 wt % of a $C_1$–$C_4$ alkyl ester of said carboxylic acid, or (3) about 0.4–10 wt % of a mixture of said carboxylic acid and said ester;

(c) about 0–5 wt % of a water-soluble alkanolamine or a water-soluble alkylene glycol; and (d) about 80–98 wt % water; and performing a metalworking operation on the metal object.

9. A method as claimed in claim 8 wherein said metal object comprises aluminum or an aluminum alloy.

10. A method as claimed in claim 9 wherein said metalworking operation comprises hot rolling or cold rolling said metal object.

11. A method as claimed in claim 9 wherein said metalworking operation comprises hot rolling said metal object at a temperature of about 232°–538° C.

12. A method as claimed in claim 8 wherein R is hydrogen, x=9–15 and y=1–5.

13. A method as claimed in claim 8 wherein R is hydrogen, x=11 and y=3.

14. A method as claimed in claim 8 wherein said lubricant composition further comprises:

(e) about 0.01–2 wt % of an antifoam agent, biocide, oxidation inhibitor, corrosion inhibitor, or mixture thereof.

15. A method as claimed in claim 8 wherein said lubricant composition consists essentially of:

(a) about 2–10 wt % of said propoxylated fatty alcohol or ether;

(b) about 0.4–4 wt % of a mixture of said carboxylic acid and said ester;

(c) about 0–2 wt % of a water-soluble alkanolamine or water-soluble $C_2$–$C_6$ alkylene glycol;

(d) about 85–97 wt % water; and (e) up to about 2 wt % of an antifoam agent, biocide, oxidation inhibitor, corrosion inhibitor, or mixture thereof.

16. A method as claimed in claim 8 wherein said lubricant composition contains about 3–6 wt % of a propoxylated fatty alcohol wherein x=9–15 and y=-1–5.

* * * * *